US005092598A

United States Patent [19]

Kamille

[11] Patent Number: 5,092,598

[45] Date of Patent: Mar. 3, 1992

[54] MULTIVALUE/MULTIPLAY LOTTERY GAME

[76] Inventor: Stuart J. Kamille, P.O. Box 129, Glenbrook, Nev. 89413

[21] Appl. No.: 416,048

[22] Filed: Oct. 2, 1989

[51] Int. Cl.[5] ..... B42D 15/00; A63B 71/00

[52] U.S. Cl. ..... 273/139; 283/903

[58] Field of Search ..... 273/138 R, 139; 283/72, 283/73, 6, 8, 100–105, 903

[56] References Cited

U.S. PATENT DOCUMENTS

| | | | |
|---|---|---|---|
| 1,527,929 | 2/1925 | Simons | 273/274 |
| 3,512,780 | 5/1970 | Allison | 273/139 |
| 3,655,198 | 4/1972 | Broughton | 273/139 |
| 3,900,219 | 8/1975 | D'Amato et al. | 273/139 X |
| 4,634,149 | 1/1987 | Donovan | 273/139 X |
| 4,738,473 | 4/1988 | Meloni et al. | 283/903 |
| 4,740,016 | 4/1988 | Konecny et al. | 283/903 |
| 4,943,090 | 7/1990 | Fienberg | 273/139 |

OTHER PUBLICATIONS

"Pennsylvania Instant Bingo", Jul. 12, 1977.

"Tropicana Play 21", The Washington Post, Fri., Dec. 18, 1981, p. D5.

*Primary Examiner*—Edward M. Coven

*Assistant Examiner*—William M. Pierce

*Attorney, Agent, or Firm*—Brian C. Kelly

[57] ABSTRACT

A Multiple Play Lottery Game for use as a promotional game or casino-style game. The game may be adapted to a dispensable card or a video format; particularly, it incorporates elements of active play by the player and player determination of the level of risk engaged as well as attributes of prize control.

3 Claims, 10 Drawing Sheets

SEVEN CARD STUD

To raise; after you select the five cards from the seven you may draw, punch out the hole in each of the five you wish to keep and turn over this card. If you wish to raise; scratch off the $5 box on the reverse side of this card and take to cashier

PLAYER MAY DRAW UP TO SEVEN CARDS

Get 1 ♠ win $1.00
Get 2 ♠ win $2.00
Get 3 ♠ win $5.00
Get 4 ♠ win $25.00
Get 1 ☠ forfeit all Get 1 ♠ win $1.00
Get 2 ♠ win $2.00
Get 3 ♠ win $5.00
Get 4 ♠ win $25.00
Get 1 ☠ forfeit all

BACCARAT

Select any number of cards
Face value over 9 is void

CRAPS

PLACE YOUR BET BY RUBBING OFF THE AREA THAT YOU WISH IF THE NUMBER REVEALED PAYS OFF IN THAT AREA-YOU WIN

EACH AREA MAY SHOW A DIFFERENT NUMBER

RUB 3 AREAS ONLY FOR THIS TICKET

MULTIVALUE/MULTIPLAY LOTTERY GAME

FIELD OF THE INVENTION

The present invention is directed to a game. While the game is applicable to use as a contest between two or more players, it is most advantageously employed as a promotional game in the field of consumer sales.

BACKGROUND OF THE INVENTION

In the prior art, prizes were allocated by the methods of predetermined allocation or probability allocation. An example of predetermined allocation is a ticket or lot having one or more covered playing areas which can be revealed by removing rub and reveal material or a number of other known methods. When the lots are printed, the game sponsor predetermines the number of winners by controlling the number of winning tickets printed.

An example of a probability allocation game is a game piece having three sections, each of which has two covered playing areas where a winning symbol is present in one of the playing areas in each section, it is randomly printed under one of the covered areas in each section. In order to win, the winning symbols must be revealed and different prizes can be allocated to each of the different sections. Probability allocation differs from predetermined allocation in that the sponsor depends on the probability distribution to control the prize allocation. Each lot is a winner, depending on the luck of the player. The problem with probability allocation is that a number of people could possibly be lucky and prize control is out of the hands of the sponsor. The disadvantage of predetermined allocation is that most lots are losers, but for a certain number of winning lots that are controlled by the sponsor. Therefore, in a predetermined game, the player feels they have little or no control over the game, whereas a probability allocation is more attractive to a player in that the player controls their own destiny by winning or losing. The present invention shows unique advantages over the prior art, by providing control over large prize allocation, while simultaneously providing the player with self-determination as to whether the ticket is a winner or not. The present invention also introduces a greater element of excitement by allowing the player to increase his risk and potential gain through progressive play.

SUMMARY OF THE INVENTION

An object of the invention is to provide a multiple play game in which the player is faced with a choice as to where the game ends, wherein the odds against his winning increase progressively as the prize purse increases in size, and the rewards the player attains are directly dependent upon the player's ability to tolerate risk.

A third object of the invention is the incorporation of a multi-valued lot system which allows a greater amount to be wagered, depending upon on a player's inference as to his chance of winning.

The present invention includes a game comprising including a game piece having one or more groups of characters printed thereon and concealed by removable concealing means wherein at least one of said characters is designated to be a winning character.

The present invention includes a method of playing a game including the steps of revealing a printed character from among at least one area of the removable concealing means of a first tier of a game piece and scoring said game piece through a scoring system.

The present invention includes variations of keno, 21, baccarat, stud poker and roulette, in addition to more simple lottery oriented games.

DESCRIPTION OF THE PREFERRED EMBODIMENTS

Figure 1:
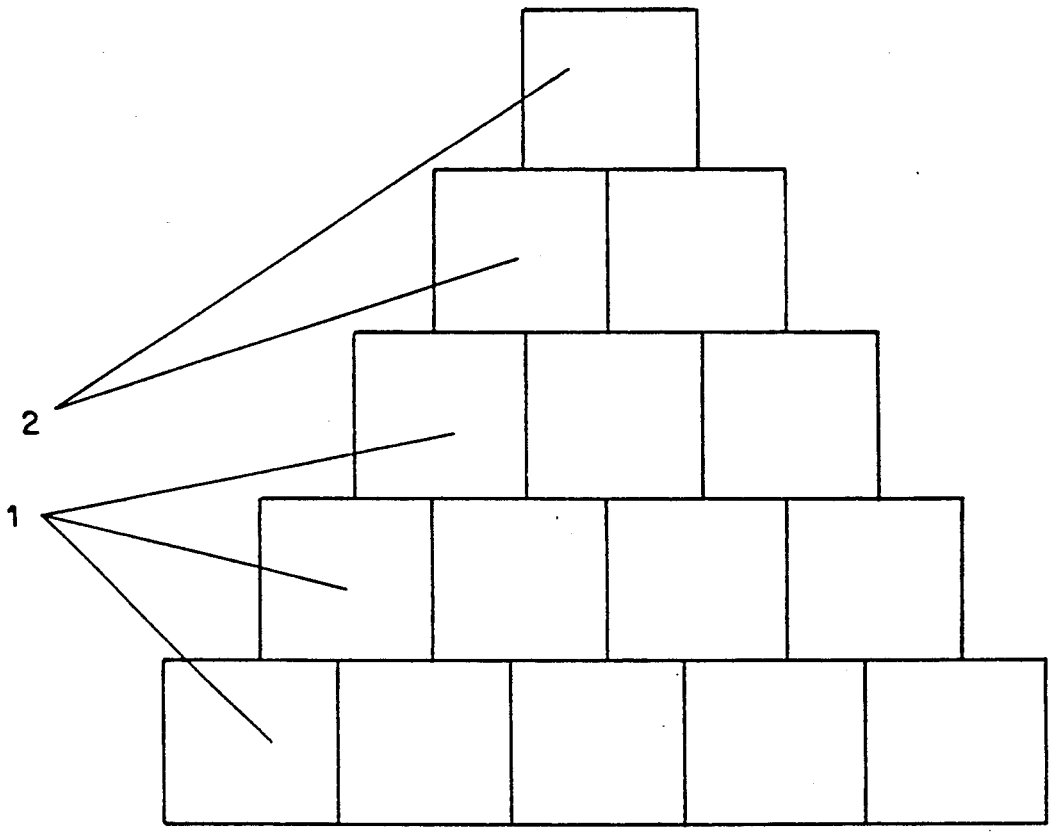
FIG. 1 is a representation of a playing surface or card at the beginning of play.

Referring to the accompanying drawings, wherein like reference numerals designate identical or corresponding parts throughout the several views. In contrast to the prior art comprising predetermined allocation and probability allocation, the present invention introduces a seeded probability game which incorporates the advantageous feature of probability allocation which allows each player a potential of winning which is determined by the laws of chance with a predetermined allocation of more expensive prizes which can be "seeded" by preselecting a limited number of winning lots to be printed. This allows the player to enjoy a feeling of excitement and participation, since every game piece can yield a prize, while at the same time offering the sponsor some control of lower level prizes through statistical estimates and an exact control over the expensive high value prizes. This invention also introduces an element of risk in that a player must risk a sure prize to play for larger prizes.

The present invention also incorporates an element of progression whereby a player can win at a certain level however the game remains afoot. The player is often faced with the choice to collect or risk it all for a greater potential gain; thus, making each tier a separate play in a multiplay game. The present invention further incorporates the use of a printed card game piece with a removable covering means for the fields of play. Said card may be sold through an automated vending machine.

FIG. 1 shows a progressive format game piece before any characters are revealed. Note the multiple tiers 1 each of which has multiple revealable characters and 2 which are preprinted in a trapezoidal arrangement.

Figure 2:
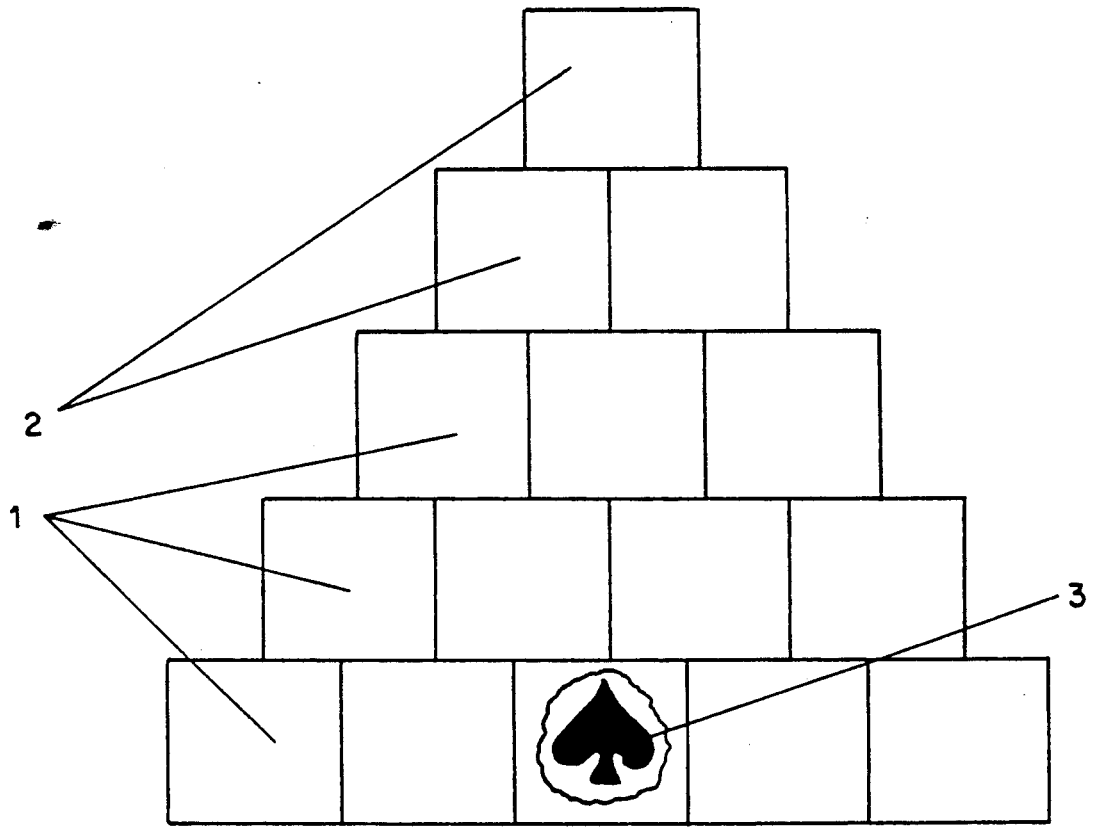
FIG. 2 is a representation of a playing surface or card of FIG. 1 wherein a character in a first group is revealed.
Figure 3:
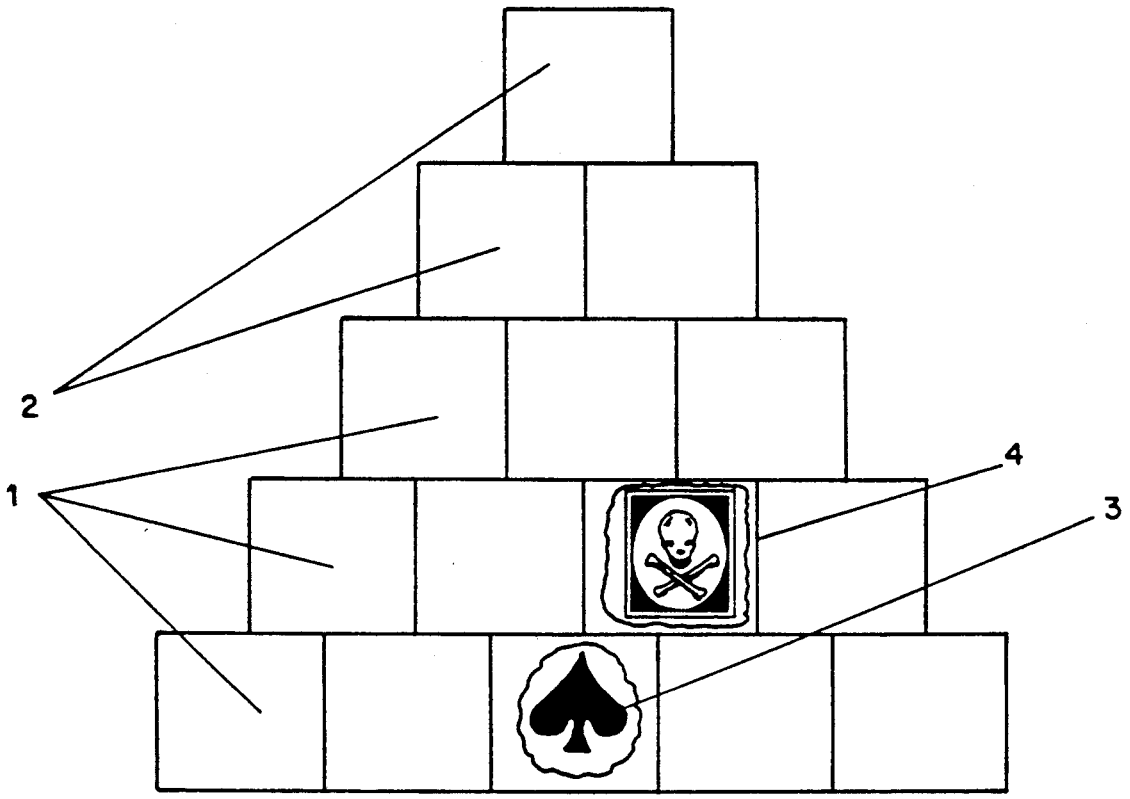
FIG. 3 is a representation of a playing surface or card of FIG. 2 wherein a character in a successive tier is revealed designating the game a loser.

The player starts play by rubbing off the concealing material from one of the areas in the first playing section 3 as shown in FIG. 2. If the winning symbol shows, in this example a space symbol, then the player would be a winner and must choose whether to collect his winnings or risk those winnings to continue play in the next successive level by attempting to get a winning symbol without revealing losing symbols as shown in FIG. 3. If a losing symbol 4 is revealed in any row or in any section, the player forfeits any winnings that may have been accumulated prior to revealing that non-winning symbol. Thus, the player builds suspense and excitement in succeeding to progressive tiers. Also, the player does not know at which tier the seeding begins or indeed whether the particular game piece he is playing is seeded for or against the player.

In an alternative embodiment, more than one winning symbol could be required to be revealed at any level.

In another alternative embodiment, a rectangular presentation using multiple winning symbols can be used to establish similar odds.

Figure 4:
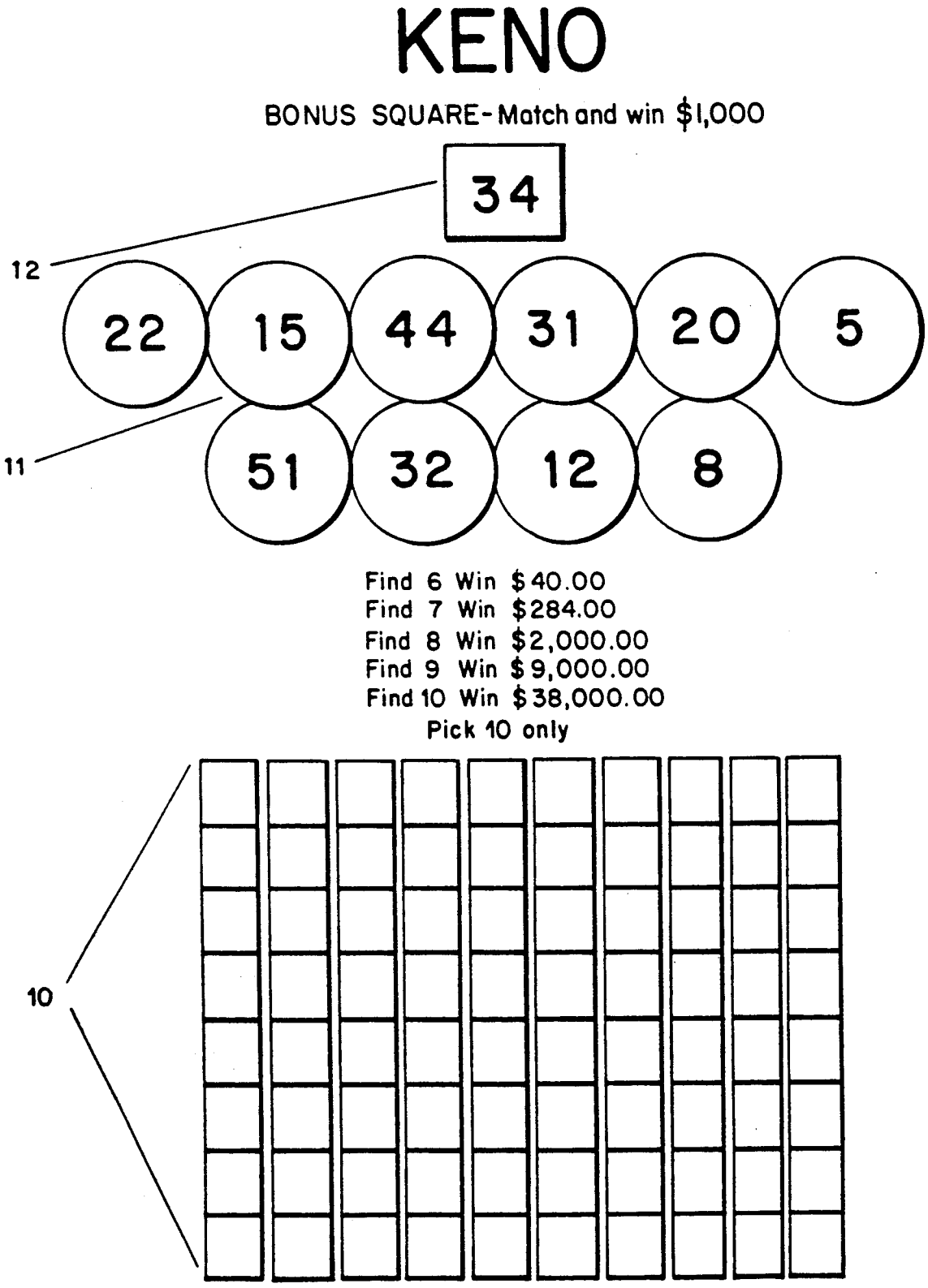
FIG. 4 is a representation of a playing surface or card for a keno game with the bonus number revealed.

In an alternative embodiment, a Keno-type game is presented at FIG. 4. It includes a field of randomly arranged numbers 10 covered by a removable concealing material, a group of target numbers 11 for the player to attempt to locate among field 10, and a bonus square 12 which provides an extra prize if it matches one of the target numbers 11 and finds all the target numbers in the field 10. This game can pay a prize for some number less than all of the target numbers. The play begins with a player attempting to uncover the target numbers. If the player has uncovered the full quantity of numbers, then he may risk the prize on the bonus number.

Figure 5:
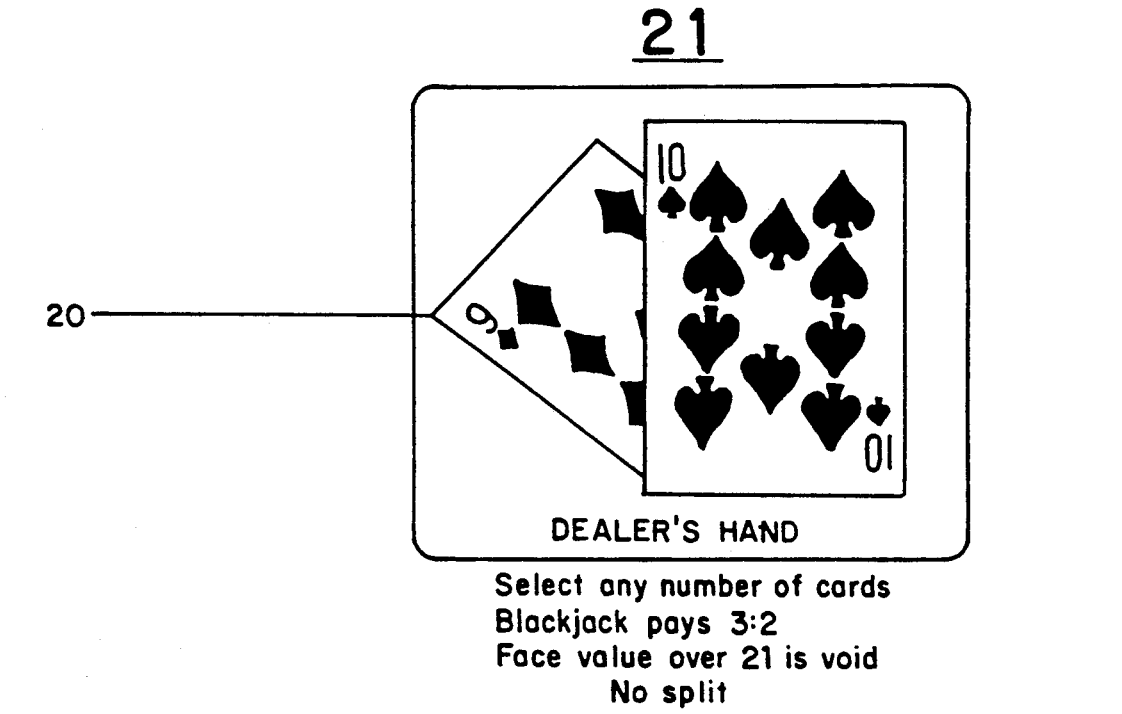
FIG. 5 is a representation of a playing surface or card of a 21 game.
Figure 5:
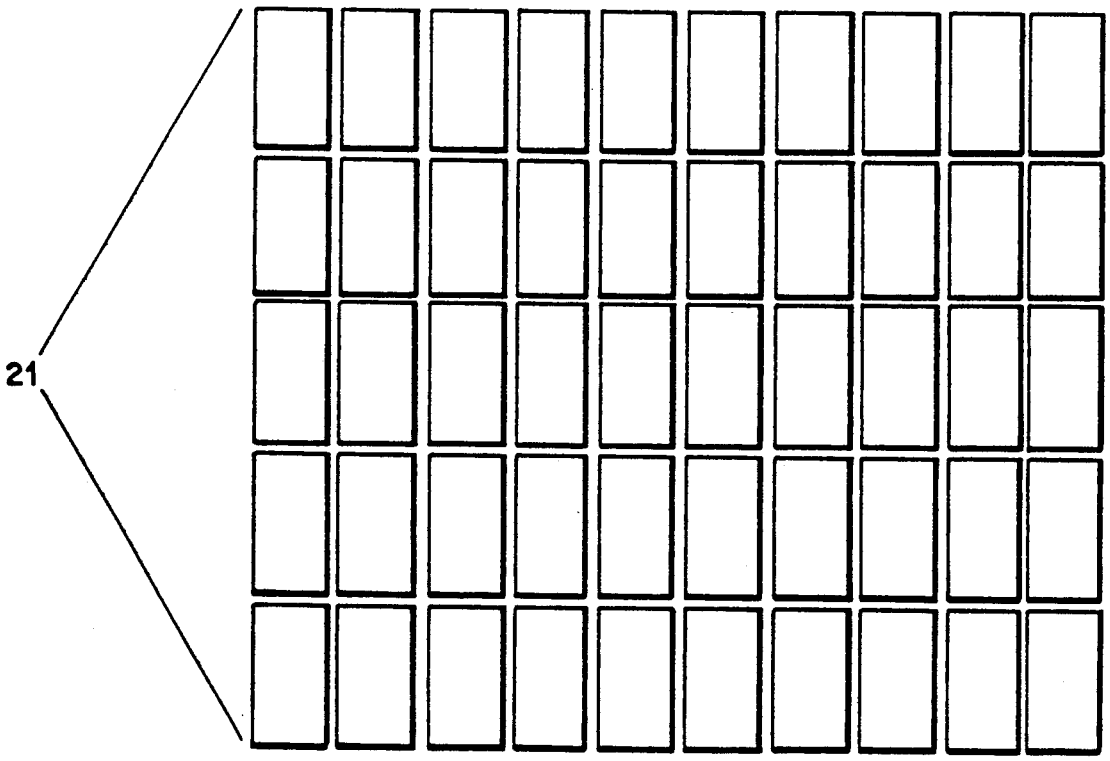

In a second alternative embodiment, a "21-type" game is presented at FIG. 5. It discloses a dealer's hand 20, and a field of the fifty remaining cards in a standard deck 21 printed in a random arrangement and covered with a removable concealing material. The game proceeds as regular "21" with no additional cards for the dealer. In an alternative embodiment, the dealer's hand can be a preselected "seventeen". As the play goes, the player reveals two cards (face cards count as ten and aces count as one or eleven as in known "21"), if less than seventeen, the player will choose again. If the player has any sum between seventeen and twenty-one, the player can win or choose again in search of low cards, as the game pays progressively more for eighteen, nineteen, twenty and twenty-one. Thus, the progression character is introduced. This game maintains the prize control by limiting the recovery for the greater hand 21, and maintains player control by having a fair deck.

In another alternative embodiment, a "21-type" game with the sole modification being a number of the randomly arranged cards are not covered. With the information of some cards being exposed and taken out of play, the player has a still more challenging game from a prospective of calculating odds for which the payoff amounts will be adjusted.

Figure 6:
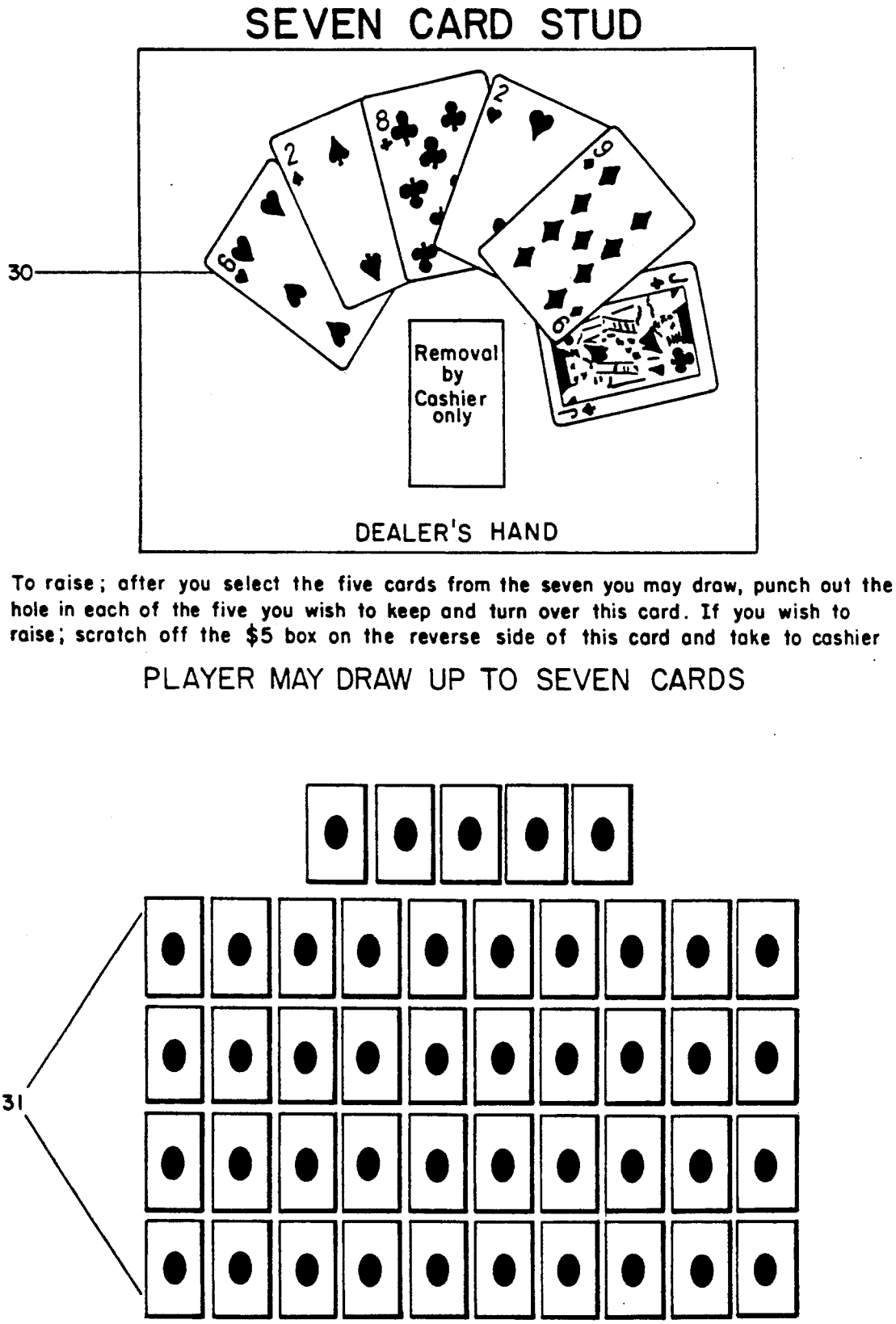
FIG. 6 is a representation of a playing surface or card of a 7-card stud game with one card of the dealer's hand not revealed and punch-outs for designating five of the seven cards are to be scored against the dealer's hand.

In a third alternative embodiment, a stud poker-type game is disclosed at FIG. 6. FIG. 6 discloses a dealer's hand 30 of six disclosed cards and one card to be revealed by the cashier, and the remaining forty-five cards 31 covered by rub and reveal material. The play begins with a player revealing seven cards and the player has the ability to raise the house based on his projection for the covered card.

In an alternative embodiment, a second card of the dealer's hand can be covered to be revealed by a cashier. The revealed cards can be seeded in another embodiment. The payoffs can be different for different hands (example, four aces, royal flush, etc.).

In an alternate embodiment, a card game could be further simulated by revealing a number of the forty-five card field to represent cards out of play like those held by other players.

Figure 7:
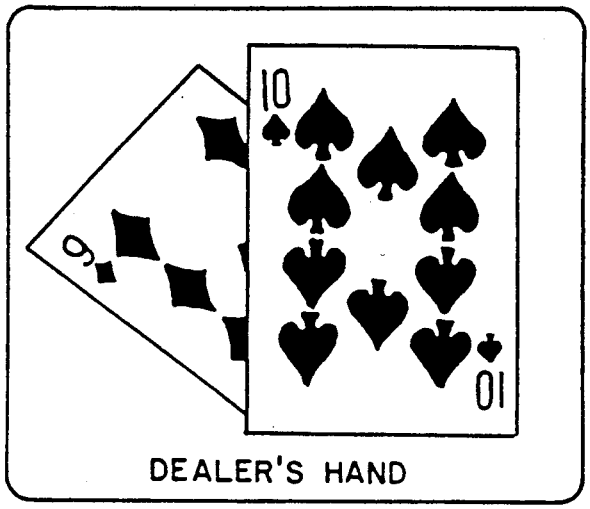
FIG. 7 is a representation of a playing surface or card of a baccarat game.
Figure 7:
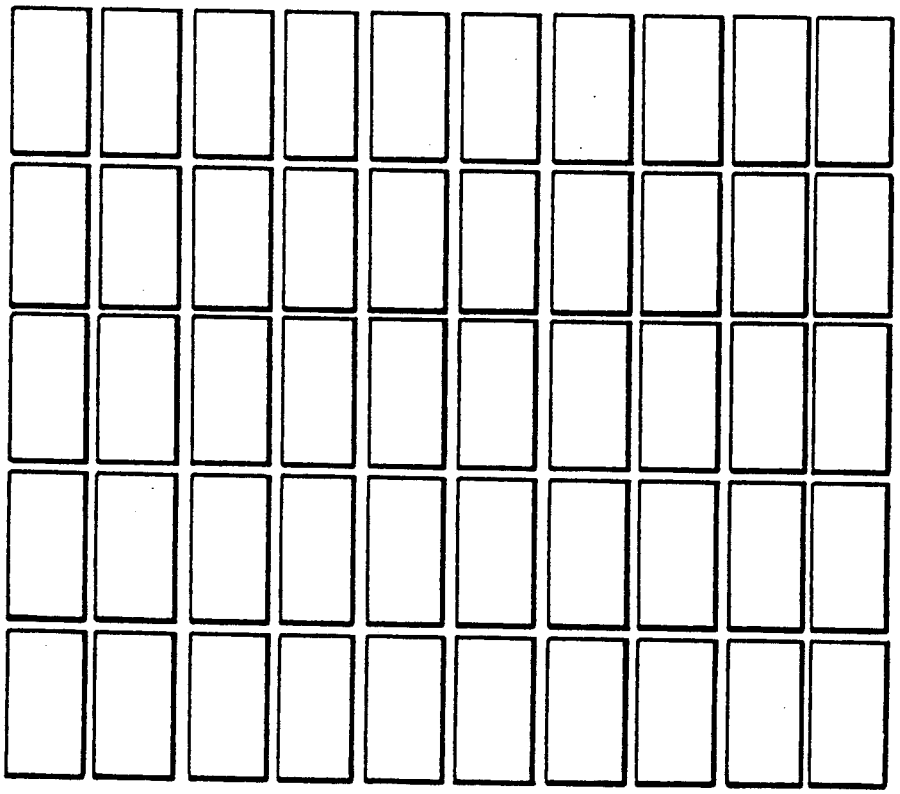

In a fourth alternate embodiment, a baccarat-type game is disclosed at FIG. 7. The method of play is similar to "21" at FIG. 5, except that standard baccarat rules apply.

Figure 8:
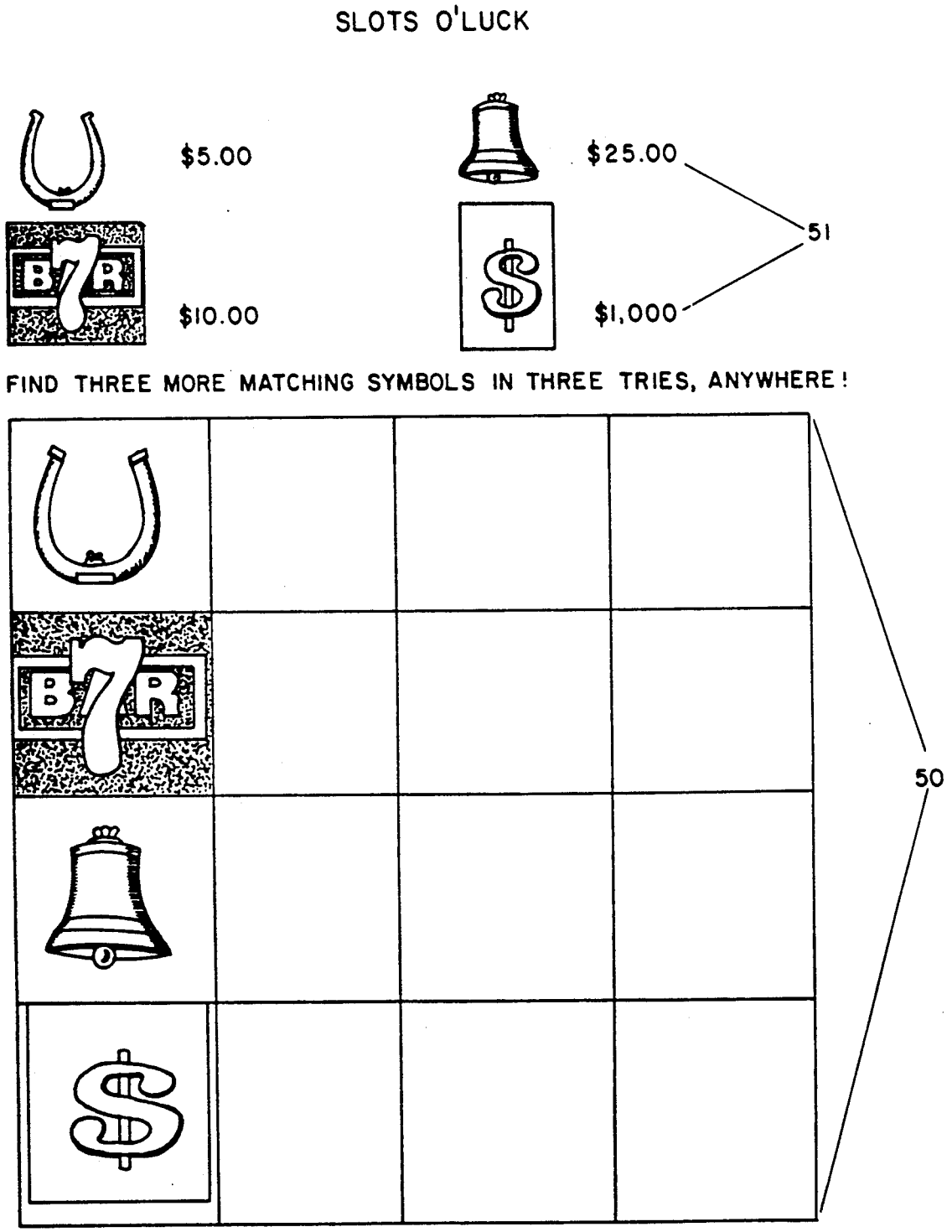
FIG. 8 is a representation of a playing surface or card of a slot machine game for matching characters.

In a fifth alternate embodiment, a slot machine-type game is disclosed at FIG. 8. The game pieces have a field of play 50 in which a player reveals three sections and, if the player can achieve a match of three of the symbols, they win according to the printed recoveries 51.

Figure 9:
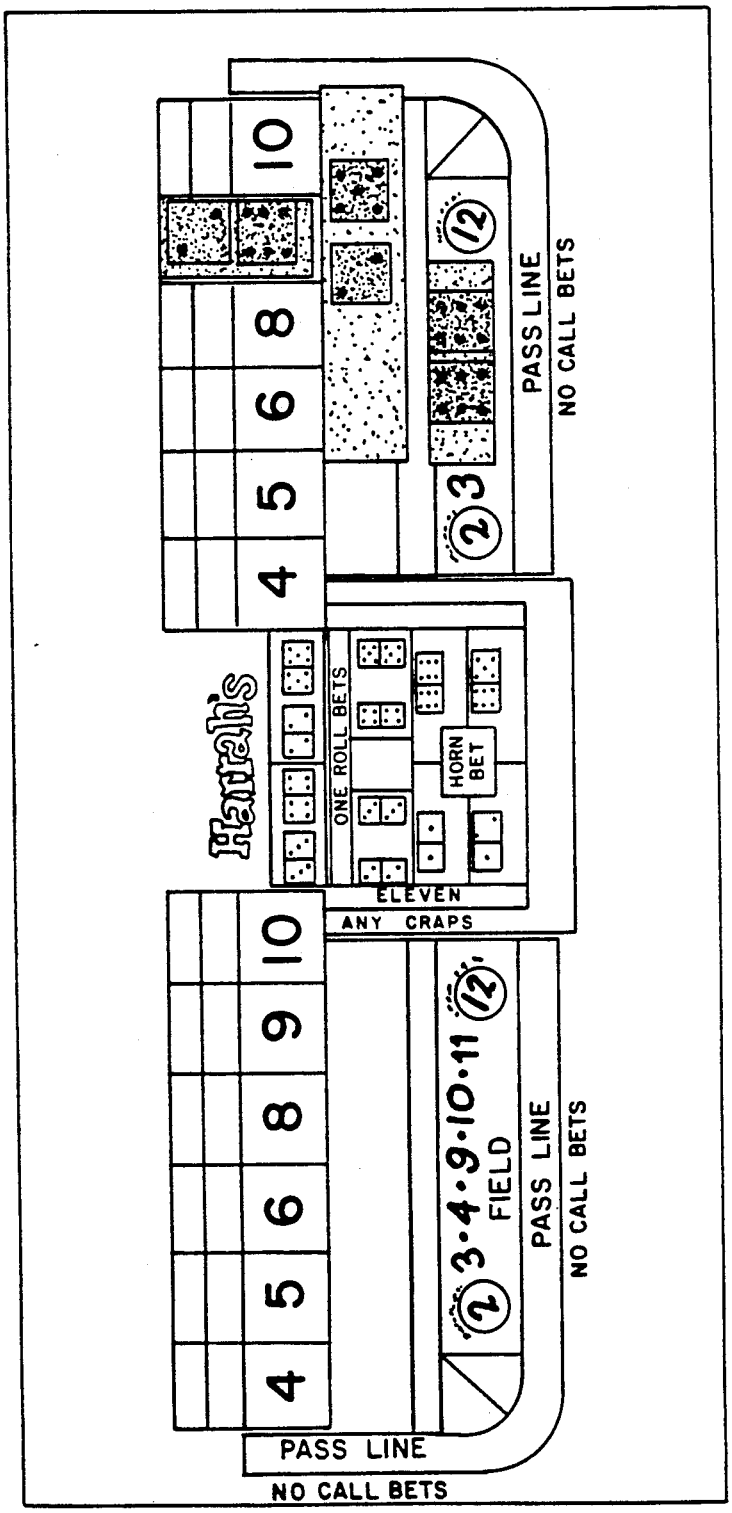
FIG. 9 is a representation of a playing surface or card of a craps game where various bets can be rub and revealed to reveal the dice as to whether they are winners or not.

In a sixth alternate embodiment, a "craps-type" game is disclosed at FIG. 9. A regular craps-type game is presented in each bet area (field, numbers, pass line, hard way, etc.) the area reveals a pair of dice and, if the dice match the required number of the area, then the player wins on the odds establish in the game.

In an alternate embodiment, compound prizes can be established other than the natural compounding of the come bet, which requires a pass line roll to match a come bet roll. Odds on a come bet can be established by requiring a non 2, 3, or 12 pass line roll to bet additional money on odds and have the cashier reveal the come roll to match the rolls.

Figure 10:
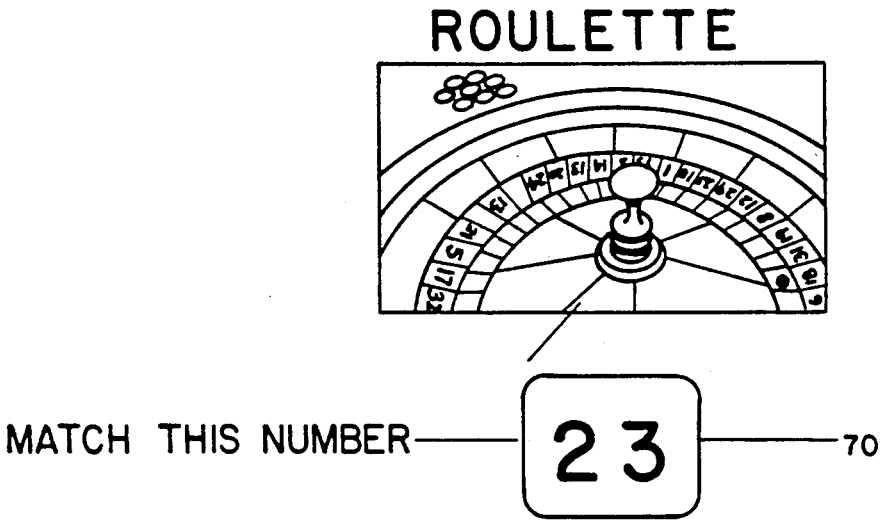
FIG. 10 is a representation of a playing surface or card for a roulette game having multiple tiers of play.
Figure 10:
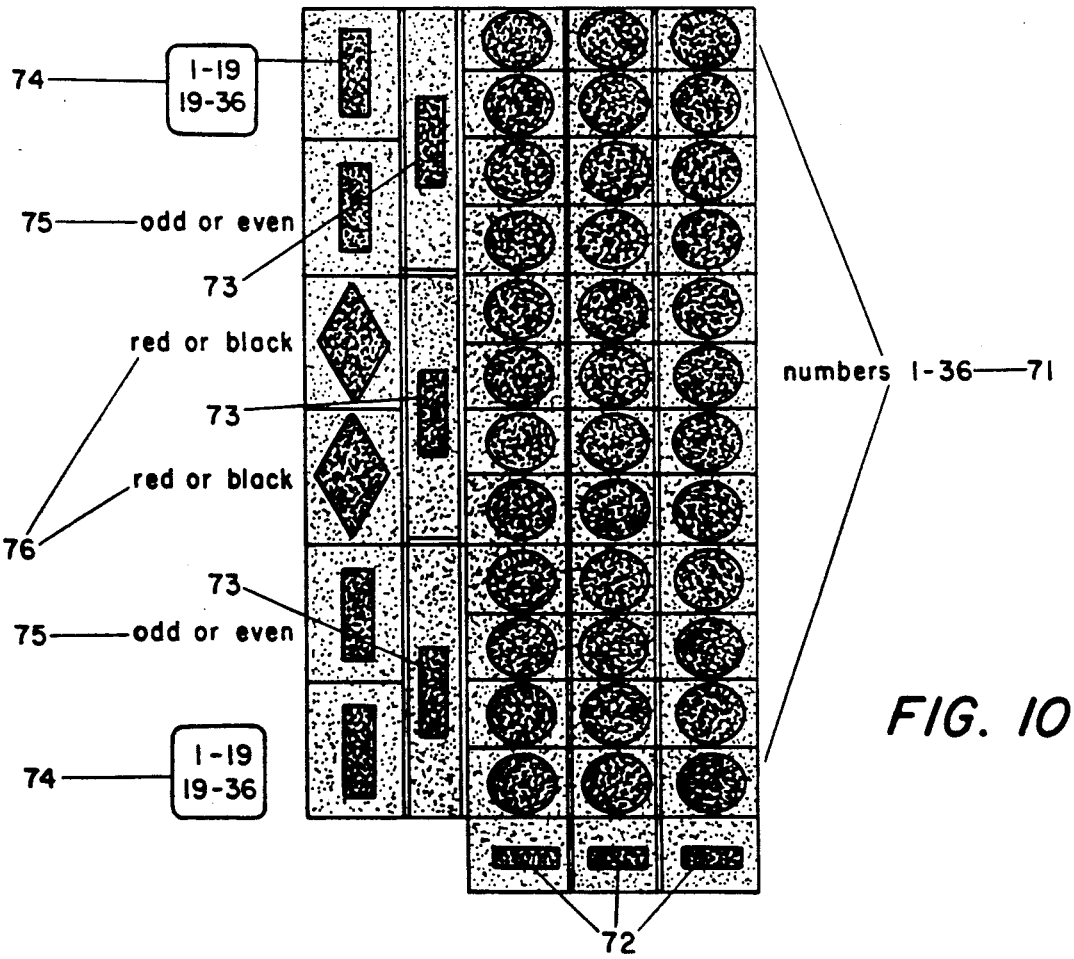

In an seventh alternate embodiment, a roulette-type game is presented at FIG. 10. It includes a target number 70, and a field of thirty-six numbers 71 randomly arranged, line bets 72, first, second and third twelve numbers bet 73, first or second eighteen bet 74, odd-even bet 75, and red-black bets 76. The method of play allows a player to begin anywhere but with the restriction that if he loses at any point, then the whole card loses.

In an eighth embodiment, a lottery game is presented where a game piece has a field of randomly arranged winning symbols printed on lower tiers and the upper tiers are seeded so that they may or may not have any winning symbols. The method of play includes allowing the player a specified number of chances to reveal symbols. Until a winning symbol is revealed, no symbols on the next successive tier can be revealed and, if the maximum number of symbols have been revealed without uncovering a winning symbol at the highest level attempted, the card is a loser.

In game surfaces, the present invention are to be employed in a promotional-type of game, and obviously, they will be single use type of playing surfaces; i.e., the playing surfaces submitted to some agency who collects and tabulates the scores. On the other hand, if the playing surface or cards are to be used in a contestant-type of game, it may be desirable to form the cards of washable-type surface, so that, once the answers and scores are tabulated, the answers can be wiped off of a card and the card reused. Obviously, whichever type of game the playing surfaces or cards are employed in, there will be a plurality of such cards, each containing different questions and clues and the degree of difficulty can be varied.

It is contemplated that these games maybe used in lotteries providing a multiplay aspect to the known lottery-type games as well as the promotional games mentioned above.

Obviously, these games could be adapted to a video-type format and there is little difference between a card and a video representation of play. It is contemplated in this application that anything that can be done on a card can be done in a video representation using video removable concealing means rather than a rub and reveal type of concealing means.

Obviously, many modification to the number of groups or rows and number of characters therein and other variations of the present invention are possible in light of the above teachings. It is therefore to be understood that within the scope of the intended claims the invention may be practiced other than as specifically described.

What is claimed and desired to be secured by Letters Patent of the U.S. is:

1. A game piece comprising one or more groups of characters printed thereon and concealed by a removable concealing means wherein at least one of said characters is pre-revealed having no concealing means, wherein said group of characters comprises the card faces of a standard four decks (2, 3, 4, 5, 6, 7, 8, 9, 10, Q, K and A) in the standard four suits (spades, diamonds, hearts and clubs) shall comprise first group wherein a sub-set of said first group of at least one of said card face characters is prerevealed on a game piece and the remaining card face characters of said first group are not revealed.

2. A game piece as described in claim 1 wherein at least one said card face character of said sub-set is concealed by removable concealing means.

3. A game piece as described in claim 1 further comprising punch-out holes at each of said card face characters of said standard deck.

* * * * *